US011348722B2

(12) United States Patent
Kim et al.

(10) Patent No.: US 11,348,722 B2
(45) Date of Patent: May 31, 2022

(54) COIL COMPONENT AND METHOD OF MANUFACTURING THE SAME

(71) Applicant: SAMSUNG ELECTRO-MECHANICS CO., LTD., Suwon-si (KR)

(72) Inventors: Jae Hun Kim, Suwon-si (KR); Jin Uk Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 569 days.

(21) Appl. No.: 16/281,801

(22) Filed: Feb. 21, 2019

(65) Prior Publication Data

US 2020/0098509 A1 Mar. 26, 2020

(30) Foreign Application Priority Data

Sep. 21, 2018 (KR) ..... 10-2018-0113925

(51) Int. Cl.

| | |
|---|---|
| ***H01F 5/00*** | (2006.01) |
| ***H01F 27/29*** | (2006.01) |
| ***H01F 27/28*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/29* (2013.01); *H01F 27/2804* (2013.01); *H01F 27/323* (2013.01); *H01F 41/041* (2013.01); *H01F 41/12* (2013.01); *H01F 2027/2809* (2013.01)

(58) Field of Classification Search

CPC ..... H01F 27/323; H01F 41/125

USPC ..... 336/200

See application file for complete search history.

(56) References Cited

U.S. PATENT DOCUMENTS

2014/0022041 A1 1/2014 Park et al.
2015/0035634 A1* 2/2015 Nakamura ..... H01F 41/046 336/170

(Continued)

FOREIGN PATENT DOCUMENTS

JP 2017-017139 A 1/2017
KR 10-2014-0011693 A 1/2014

(Continued)

OTHER PUBLICATIONS

English translation of KR20140137306 (Year: 2014).*
Korean Office Action dated Jun. 20, 2019 issued in Korean Patent Application No. 10-2018-0113925 (with English translation).

*Primary Examiner* — Ronald Hinson
(74) *Attorney, Agent, or Firm* — Morgan, Lewis & Bockius LLP

(57) ABSTRACT

A coil component includes a body; an internal insulating layer buried in the body; insulating walls disposed on the internal insulating layer, and including openings each having a planar coil shape having at least one turn; coil patterns including first conductive layers disposed in the openings, and second conductive layers disposed between the first conductive layers and internal surfaces of the openings, and each having a first surface in contact with the internal insulating layer and a second surface opposing the first surface; and a recessed portion formed on the second surface of each of the coil patterns and exposing at least portions of the openings of the internal walls.

15 Claims, 5 Drawing Sheets

(56) References Cited

U.S. PATENT DOCUMENTS

| | | | | |
|---|---|---|---|---|
| 2016/0351316 | A1* | 12/2016 | Oh | H01F 27/325 |
| 2018/0100076 | A1* | 4/2018 | Lakrout | C09D 11/38 |
| 2018/0174729 | A1 | 6/2018 | Kim | |
| 2018/0261377 | A1 | 9/2018 | Kim | |

FOREIGN PATENT DOCUMENTS

| | | | |
|---|---|---|---|
| KR | 10-2014-0137306 | A | 12/2014 |
| KR | 10-2018-0072483 | A | 6/2018 |
| KR | 10-2018-0102471 | A | 9/2018 |

* cited by examiner

COIL COMPONENT AND METHOD OF MANUFACTURING THE SAME

CROSS-REFERENCE TO RELATED APPLICATION(S)

This application claims the benefit of priority to Korean Patent Application No. 10-2018-0113925 filed on Sep. 21, 2018 in the Korean Intellectual Property Office, the disclosure of which is incorporated herein by reference in its entirety.

TECHNICAL FIELD

The present disclosure relates to a coil component and a method of manufacturing the same.

BACKGROUND

An inductor, a coil component, is a representative passive electronic component used together with a resistor and a capacitor in electronic devices.

Among coil components, a thin film coil component may be manufactured through processes of forming a coil through a plating process, manufacturing a body after curing a magnetic powder-resin composite in which a magnetic powder and a resin are mixed, and forming an external electrode in an outer portion of the body.

As electronic devices are designed to have higher performance and to be reduced in size, electronic components used in electronic devices have been increased in number and reduced in size. Accordingly, a thin film coil component is also designed to be reduced in size.

However, when a thin film coil component is small-sized, a volume of a magnetic material implementing properties of the component may be reduced, and there may be limitations in increasing a line width or a line thickness of a coil, which may cause degradation of properties.

Thus, to reduce a size of an electronic component, it may be necessary to configure an external electrode to have a reduced thickness.

SUMMARY

An aspect of the present disclosure is to provide a coil component having improved product properties and a method of manufacturing the same.

According to an aspect of the present disclosure, a coil component includes a body; an internal insulating layer buried in the body; insulating walls disposed on the internal insulating layer, and including openings each having a planar coil shape having at least one turn; coil patterns including first conductive layers disposed in the openings, and second conductive layers disposed between the first conductive layers and internal surfaces of the openings, and each having a first surface in contact with the internal insulating layer and a second surface opposing the first surface; and a recessed portion formed on the second surface of each of the coil patterns and exposing at least portions of the openings of the internal walls.

According to an aspect of the present disclosure, a coil component includes a body; an internal insulating layer buried in the body; insulating walls disposed on the internal insulating layer, and including openings each having a planar coil shape having at least one turn; and coil patterns including first conductive layers disposed in the openings, and second conductive layers disposed between the first conductive layers and internal surfaces of the openings, and each having a first surface in contact with the internal insulating layer and a second surface opposing the first surface. A height of each of the insulating walls is greater than a height of each of the coil patterns in a stacking direction, such that the insulating walls protrude from the second surface of each of the coil patterns.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
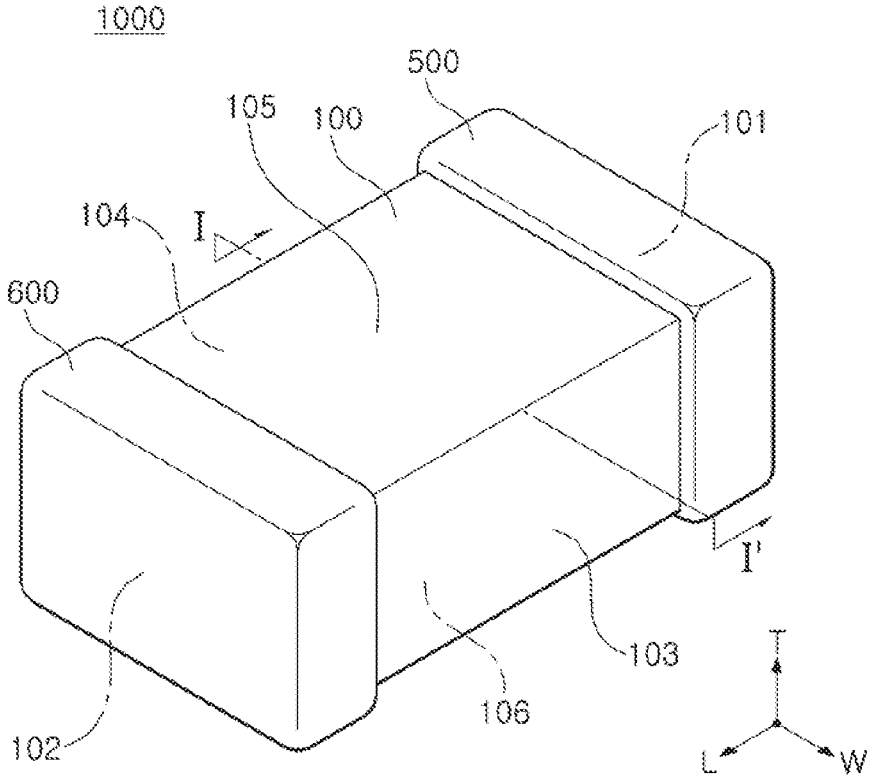
FIG. 1 is a schematic diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or below an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

Coil Component

Figure 2:
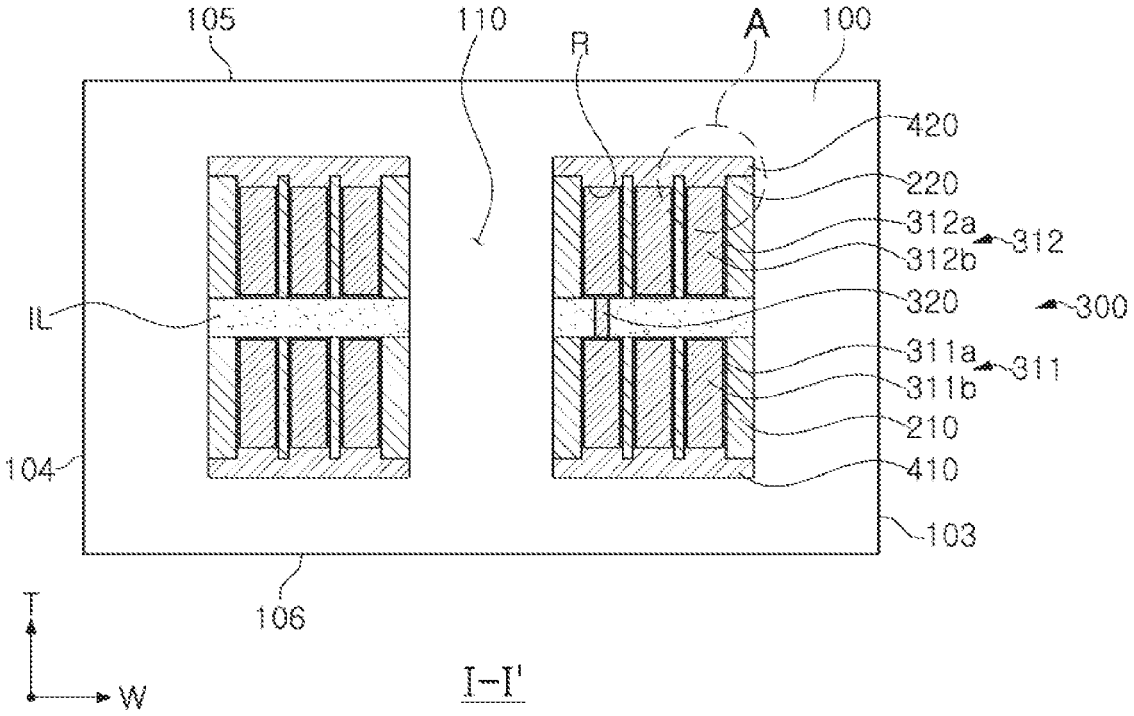
FIG. 2 is a cross-sectional diagram taken along line I-I' in FIG. 1.
Figure 3:
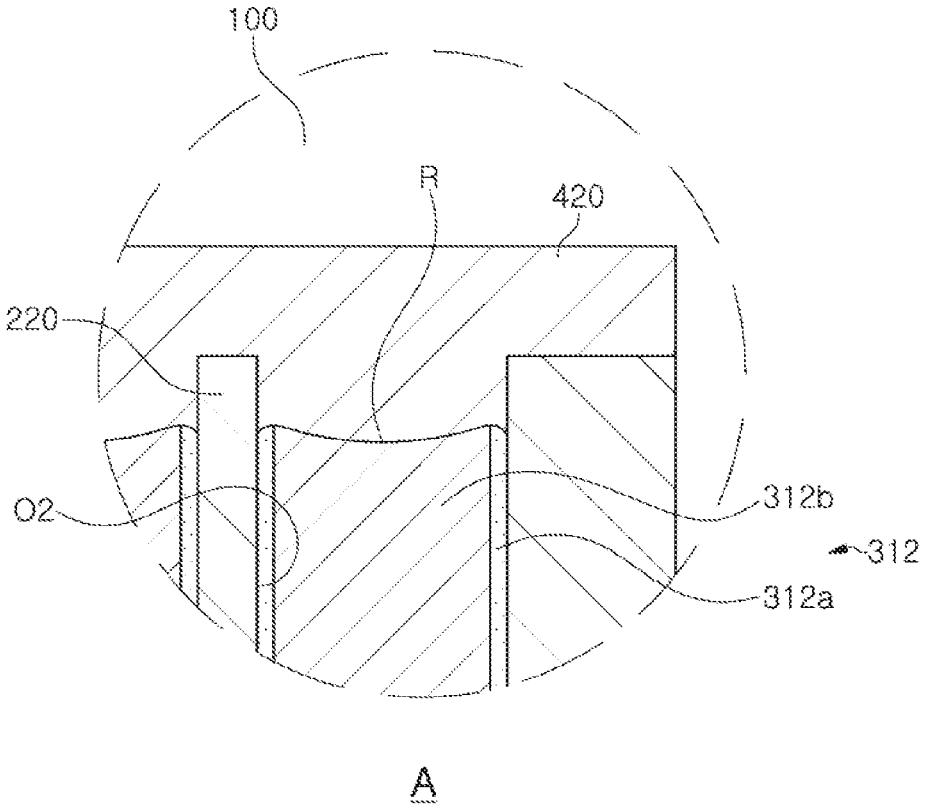
FIG. 3 is a diagram illustrating portion A illustrated in FIG. 2 in magnified form.

FIG. 1 is a schematic diagram illustrating a coil component according to an exemplary embodiment. FIG. 2 is a cross-sectional diagram taken along line I-I' in FIG. 1. FIG. 3 is a diagram illustrating portion A illustrated in FIG. 2 in magnified form.

Referring to FIGS. 1 to 3, a coil component 1000 according to the exemplary embodiment may include a body 100, an internal insulating layer IL, insulating walls 210 and 220, a coil portion 300, and a recessed portion R, and may further include cover insulating layers 410 and 420, and external electrodes 500 and 600.

The body 100 may form an exterior of the coil component 1000, and may bury the coil portion 300 therein.

The body 100 may have a hexahedral shape.

Referring to FIGS. 1 to 3, the body 100 may include a first surface 101 and a second surface 102 opposing each other in a length direction L, a third surface 103 and a fourth surface 104 opposing each other in a width direction W, a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body. Also, one surface and the other surface of the body 100 may refer to the fifth surface 105 and the sixth surface 106 of the body 100.

As an example, the body 100 may be configured such that the coil component 1000 on which the external electrodes 500 and 600 are disposed may have a length of 2.0 mm, a width of 1.2 mm, and a thickness of 0.65 mm, but an exemplary embodiment thereof is not limited thereto.

The body 100 may include a magnetic material and a resin material. For example, the body 100 may be formed by layering one or more magnetic composite sheets including a resin and a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite powder may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more materials selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an example of the magnetic metal powder is not limited thereto.

The ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, crystallinity, and a form of one of magnetic materials is different from those of the other magnetic material.

The resin may include one of an epoxy, a polyimide, a liquid crystal polymer, or mixture thereof, but an example of the resin is not limited thereto.

The body 100 may include a core 110 penetrating through a coil portion 300. The core 110 may be formed by filling a through-hole of the coil portion 300 with a magnetic composite sheet, but an exemplary embodiment thereof is not limited thereto.

The internal insulating layer IL may be buried in the body 100. The internal insulating layer IL may support the insulating walls 210 and 220 and the coil portion 300.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 300. When the internal insulating layer IL is formed of an insulating material including a photosensitive insulating resin, the number of processes for forming the coil portion 300 may be reduced such that manufacturing costs may be reduced, and a fine via may be formed.

The insulating walls 210 and 220 may be disposed on the internal insulating layer IL, and may have openings O1 and O2 each having a planar coil shape having at least one turn. Coil patterns 311 and 312 may be disposed in the openings.

As the coil portion 300 includes the first and second coil patterns 311 and 312 respectively disposed on both surfaces of the internal insulating layer IL, the insulating walls 210 and 220 may be disposed on the internal insulating layer IL.

The planar coil shape of the openings O1 and O2 may be a spiral shape, but an example of the shape is not limited thereto.

The insulating walls 210 and 220 may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photosensitive resin, a parylene, and SiOx or SiNx. As an example, although not limited thereto, the insulating walls 210 and 220 may include a photosensitive insulating resin. In other words, the insulating walls 210 and 220 may be formed of a photosensitive insulating resin in which one type of a photo acid generator (PAG) and various types of epoxy resins are mixed, and one or more types of epoxy resins may be used. When the insulating walls 210 and 220 include a photosensitive insulating resin, the openings O1 and O2 may be formed through a photolithography process.

When an aspect ratio (AR) between the insulating walls 210 and 220 is significantly low, capacity may reduce due to reduction of a magnetic material area, and when the aspect ratio is significantly high, it may be difficult to form a pattern. Thus, as an example, although not limited thereto, an aspect ratio between the insulating walls 210 and 220 may be within a range of 5:1 to 25:1.

The coil portion 300 may be buried in the body 100 and may embody properties of a coil component. For example, when the coil component 1000 is used as a power inductor, the coil portion 300 may store an electric field as a magnetic field such that an output voltage may be maintained, thereby stabilizing power of an electronic device.

The coil portion 300 may be formed on the internal insulating layer IL, and may form at least one turn. In the exemplary embodiment, the coil portion 300 may include the first and second coil patterns 311 and 312 respectively formed on both surfaces of the internal insulating layer IL opposing each other in a thickness direction T of the body 100, and a via 320 penetrating through the internal insulating layer IL to connect the first and second coil patterns 311 and 312.

The first and second coil patterns 311 and 312 may respectively be disposed in the openings O1 and O2 each having a planar coil shape on the insulating walls 210 and 220. Thus, the first and second coil patterns 311 and 312 each may have a planar coil pattern forming at least one turn centered on the core 110 as an axis. For example, the first coil pattern 311 may form at least one turn centered on the core 110 as an axis on one surface of the internal insulating layer IL disposed in a lower portion as illustrated in FIG. 2.

Ends of the first coil pattern 311 and the second coil pattern 312 may respectively be connected to the first and second external electrodes 500 and 600. In other words, the end of the first coil pattern 311 may be connected to the first external electrode 500, and the end of the second coil pattern 312 may be connected to the second external electrode 600.

As an example, the end of the first coil pattern 311 may be exposed to the first surface 101 of the body 100, and the end of the second coil pattern 312 may be exposed to the second surface 102 of the body 100 such that the first and second coil patterns 311 and 312 may be in contact with and connected to the first and second external electrodes 500 and 600 respectively disposed on the first and second surfaces 101 and 102 of the body 100.

The first and second coil patterns 311 and 312 may respectively include first conductive layers 311*b* and 312*b*, and second conductive layers 311*a* and 312*a* disposed between the first conductive layers 311*b* and 312*b* and internal surfaces of the openings O1 and O2, and may have one surface being in contact with the internal insulating layer IL and the other surface opposing the one surface. In other words, the first coil pattern 311 may include the first conductive layer 311*b* disposed in the first opening O1 of the first insulating wall 210, and the second conductive layer 311*a* disposed between the first conductive layer 311*b* and an internal surface of the first opening O1. The second coil pattern 312 may include the first conductive layer 312*b* disposed in the second opening O2 of the second insulating wall 220, and the second conductive layer 312*a* disposed between the first conductive layer 312*b* and an internal surface of the second opening O2. The internal surfaces of the openings O1 and O2 may refer to regions of the insulating walls 210 and 220 exposed through the openings O1 and O2, where the insulating walls 210 and 220 are internal surfaces of the openings O1 and O2, and regions of both surfaces of the internal insulating layer IL exposed through the openings O1 and O2, where the both surfaces of the internal insulating layer IL are lower surfaces of the openings O1 and O2.

When the coil patterns 311 and 312 are formed through a plating method, the second conductive layers 311*a* and 312*a* may be seed layers endowing the internal surfaces of the electrically insulated openings O1 and O2 with conductivity. In other words, when the first conductive layers 311*b* and 312*b* are electroplating layers, the second conductive layers 311*a* and 312*a* may allow a conductive material to be formed in the openings O1 and O2 by an electrical plating method.

When line widths of the coil patterns 311 and 312 are excessively large, a volume of a magnetic material in a volume of the body 100 may reduce, which may degrade inductance. As an example, although not limited thereto, an aspect ratio (AR) between the coil patterns 311 and 312 may be within a range of 3:1 to 9:1.

The coil patterns 311 and 312 and the via 320 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

The recessed portion R may be formed on the other surfaces of the coil patterns 311 and 312 and may expose at least portions of internal walls of the openings O1 and O2. By the recessed portion R, heights (lengths from one surfaces to the other surfaces) of the coil patterns 311 and 312 may be shorter than heights (lengths from one surfaces of the insulating walls being in contact with the internal insulating layer to the other surfaces of the insulating walls opposing one surfaces of the insulating walls) of the insulating walls 210 and 220. Thus, the recessed portion R may prevent turns of the coil patterns 311 and 312 from being electrically connected to each other through the other surfaces of the insulating walls 210 and 220.

The recessed portion R may be formed on cross-sectional surfaces of the coil patterns 311 and 312 and protrude to the first conductive layers 311*b* and 312*b*. In other words, as illustrated in FIG. 3, the recessed portion R may be configured such that an inner portion of the recessed portion R is further recessed into the internal insulating layer than an outer portion in a region between internal walls of the openings O1 and O2 of the insulating walls 210 and 220. The recessed portion R may be disposed on the other surfaces of the coil patterns 311 and 312 through an etching process. When an etchant has isotropic properties, the above described structure may be implemented. When the second conductive layers 311*a* and 312*a* are formed through an electroless plating process, a speed of etching the second conductive layers 311*a* and 312*a* may be higher than a speed of etching the first conductive layers 311*b* and 312*b*.

The cover insulating layers 410 and 420 may cover the insulating walls 210 and 220 and the recessed portion R. In other words, the cover insulating layers 410 and 420 may bury the coil patterns 311 and 312 in the cover insulating layers 410 and 420 along with the insulating walls 210 and 220 such that the coil patterns 311 and 312 may be electrically insulated with the body 100.

The cover insulating layers 410 and 420 may include at least one material selected from a group consisting of an epoxy resin, a polyimide resin, and a liquid crystalline polymer resin.

The cover insulating layers 410 and 420 may be formed by layering an insulating film for forming a cover insulating layer such as a dry film (DF). Alternatively, the cover insulating layers 410 and 420 may be formed through a vapor deposition process (VD). The cover insulating layers 410 and 420 may also be formed by applying a liquid insulating material through a process such as a spin coating process.

FIGS. 2 and 3 illustrate the cover insulating layers 410 and 420 are only formed on the insulating walls 210 and 220 and the coil patterns 311 and 312, but an exemplary embodiment thereof is not limited thereto. As another example, the cover insulating layers 410 and 420 may be formed along the coil patterns 311 and 312 and a surface of the internal insulating layer IL. In this case, the cover insulating layers 410 and 420 may include a parylene, and the like.

The external electrodes 500 and 600 may include a metal having high electrical conductivity. For example, the external electrodes 500 and 600 may be formed of nickel (Ni), copper (Cu), tin (Sn), or silver (Ag), or alloys thereof.

A plating layer (not illustrated) may be formed on the external electrodes 500 and 600, and in this case, the plating layer may include one or more materials selected from a group consisting of nickel (Ni), copper (Cu), and tin (Sn). For example, a nickel (Ni) plated layer and a tin (Sn) plated layer may be formed in order.

The larger the cross-sectional area of a coil pattern, the lower the direct current resistance thereof may be, one of main properties of an inductor. Also, the larger the area of a magnetic material through which a magnetic flux passes, the higher the inductance is, another main property of an inductor. Thus, to decrease direct current resistance and to improve inductance, it may be necessary to increase a cross-sectional area of a coil pattern and an area of a magnetic material by increasing a line width or a line thickness of a coil pattern.

However, when a coil pattern is formed by an electrical plating method, there has been a limitation in increasing a cross-sectional area of a coil pattern.

When increasing a line width of a coil pattern, a limited number of turns of a coil pattern may be implemented, which may lead to a reduction of an area of a magnetic material. Accordingly, effectiveness may degrade, and it may be difficult to implement a high capacity product. When increasing a thickness of a coil pattern, while a plating process is undertaken, it is highly likely that shorts may occur between adjacent coil conductors due to an isotopic growth in which a coil pattern grows in a thickness direction and in a width direction simultaneously, and it may thus be difficult to decrease direct current resistance.

In the exemplary embodiment, by forming the insulating walls 210 and 220 having the openings O1 and O2, each having a planar coil shape and forming the coil patterns 311 and 312 in the openings O1 and O2, the insulating walls 210 and 220 may serve as a plating growth guide. Accordingly, it may be easy to adjust the shapes of the coil patterns 311 and 312, and a coil having a high aspect ratio may be implemented, thereby implementing a coil component having improved product properties.

Also, in the coil component 1000 in the exemplary embodiment, differently from a general coil pattern formed through a plating process, the second conductive layers 311*a* and 312*a*, which are seed layers, may be formed along internal surfaces of the openings O1 and O2 in which turns of the coil patterns 311 and 312 are respectively disposed. Thus, differently from a general coil pattern, a partial removal of the internal insulating layer IL and a partial removal of an electroplating layer may be prevented while patterning a seed layer. Also, differently from a general coil pattern, regions of the second conductive layers 311*a* and 312*a* being in contact with the internal insulating layer IL may not be removed, thereby preventing cohesion force between the coil pattern and the internal insulating layer from being weakened.

Also, in the coil component 1000 in the exemplary embodiment, the recessed portion R may be formed on the other surfaces of the coil patterns 311 and 312 to prevent turns of the coil patterns 311 and 312 from being electrically connected to each other through the other surfaces of the insulating walls 210 and 220. The configuration described above may be distinct from a general configuration in which an insulating wall, a seed layer, and a plating layer are removed together through a grinding process after over-coating. Thus, in the exemplary embodiment, deformation of a coil pattern, an internal insulating layer, and an insulating wall, or isolation of a coil pattern, an internal insulating layer, and an insulating wall from one another, which occur in a general grinding process, may be prevented. Further, when a method in which a grinding process is performed after over-coating is used, it may be difficult to set an accurate reference surface of a grinding process when a grinding process is performed, but in the exemplary embodiment, as a grinding process is not performed, the above issue may be prevented.

Method of Manufacturing Coil Component

FIGS. 4 to 8 are diagrams illustrating processes of manufacturing a coil component according to an exemplary embodiment.

Figure 4:
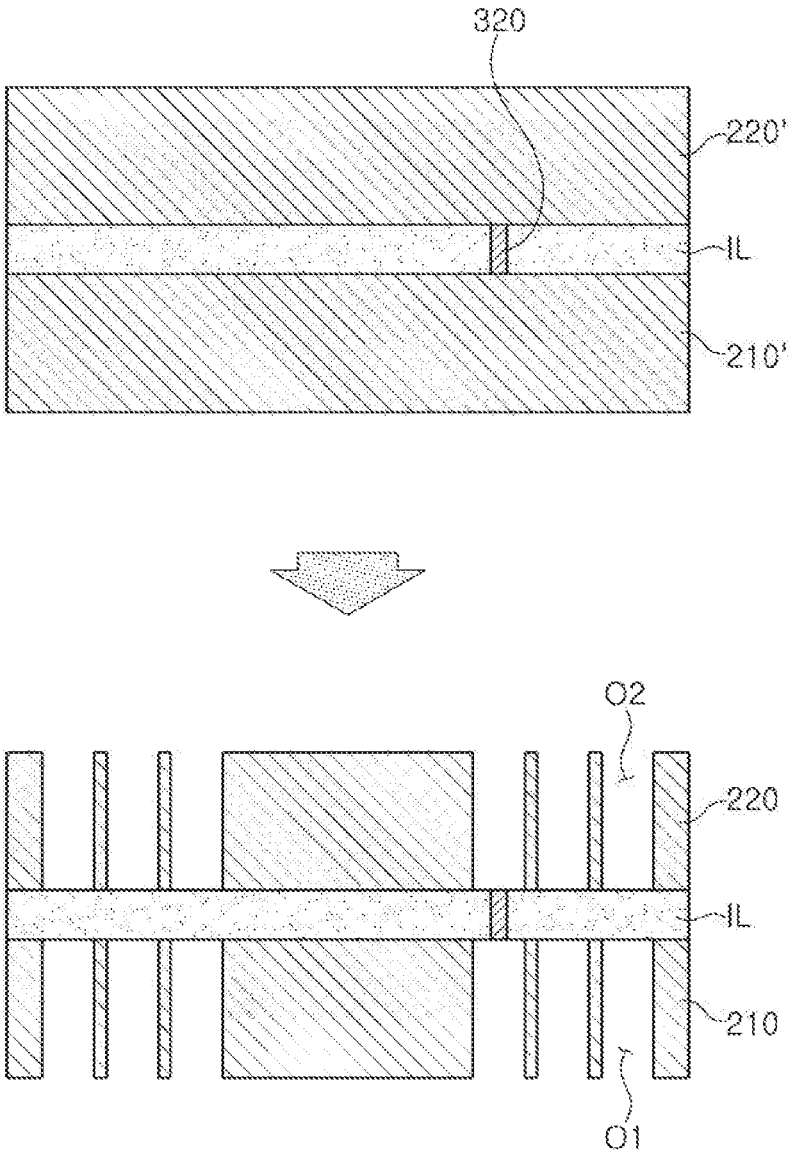
FIGS. 4 to 8 are diagrams illustrating processes of manufacturing a coil component according to an exemplary embodiment in the present disclosure.

Referring to FIG. 4, insulating walls 210 and 220 having openings O1 and O2 each having a planar coil shape may be formed on at least one of both surfaces of an internal insulating layer IL on which a via 320 is formed.

In the exemplary embodiment, a method of forming a via is not limited to any particular method. The via 320 may be formed by forming a via hole penetrating through both surfaces of the internal insulating layer IL, forming a seed layer for forming a via on an internal wall of a through-hole, and forming a conductive material in the through-hole through an electrical plating process. The seed layer for forming a via may be formed on an overall surface of the internal insulating layer IL including an internal wall of the through-hole, the through-hole may be filled through an electrical plating, and the seed layer may be removed by etching or grinding a region remaining on both surfaces of the internal insulating layer.

In the exemplary embodiment, the method of forming the insulating walls 210 and 220 having the openings O1 and O2 each having a planar coil shape may not be limited to any particular method. As an example, although not limited thereto, the insulating walls 210 and 220 having the openings O1 and O2 each having a planar coil shape may be formed by forming insulating sheets 210' and 220' on both surfaces of the internal insulating layer IL, forming masks having opening patterns corresponding to the openings O1 and O2 on the insulating sheets 210' and 220', selectively removing the insulating sheets 210' and 220' exposed to the opening patterns of the masks, and removing the masks.

As another example, when the insulating sheets 210' and 220' layered on both surfaces of the internal insulating layer IL include a photosensitive insulating resin, the insulating walls 210 and 220 having the openings O1 and O2 may be formed by directly performing a photolithography process to the insulating sheets 210' and 220'.

Figure 5:
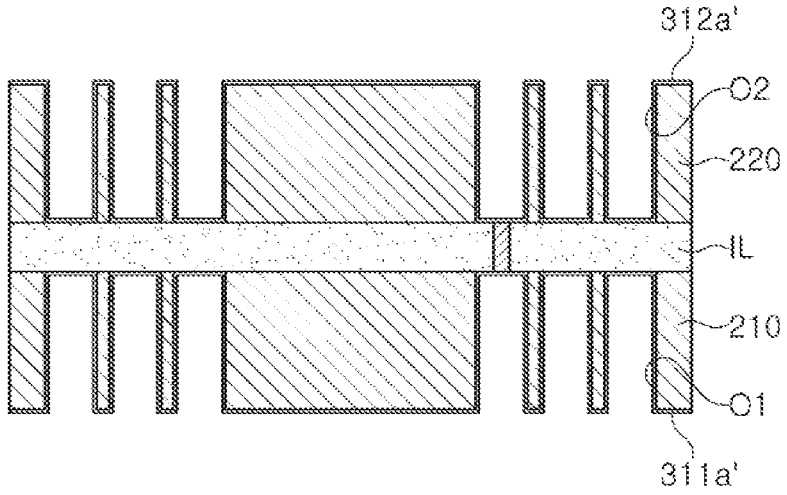

Referring to FIG. 5, seed portions 311*a*' and 312*a*' may be formed along surfaces of the insulating walls 210 and 220 including internal surfaces of the openings O1 and O2.

The seed portions 311*a*' and 312*a*' may be come the second conductive layers 311*a* and 312*a* described above through a subsequent process, and may be formed by a electroless plating method or a carbon-based direct metallization (eclipse) method. When the seed portions 311*a*' and 312*a*' are formed by an electroless copper plating method, the seed portions 311*a*' and 312*a*' may include copper (Cu).

As another example, differently from the examples illustrated in FIGS. 4 and 5, the seed layer for forming a via described above may be a portion of the seed portions 311*a*' and 312*a*'. In other words, differently from the description described above, by forming a via hole penetrating through both surfaces of the internal insulating layer IL, forming the insulating walls 210 and 220 including internal surfaces of the openings O1 and O2 on the internal insulating layer IL on which the via hole is formed, and forming the seed portions 311*a*' and 312*a*', the seed portions 311*a*' and 312*a*' may also be formed in the via hole.

Figure 6:
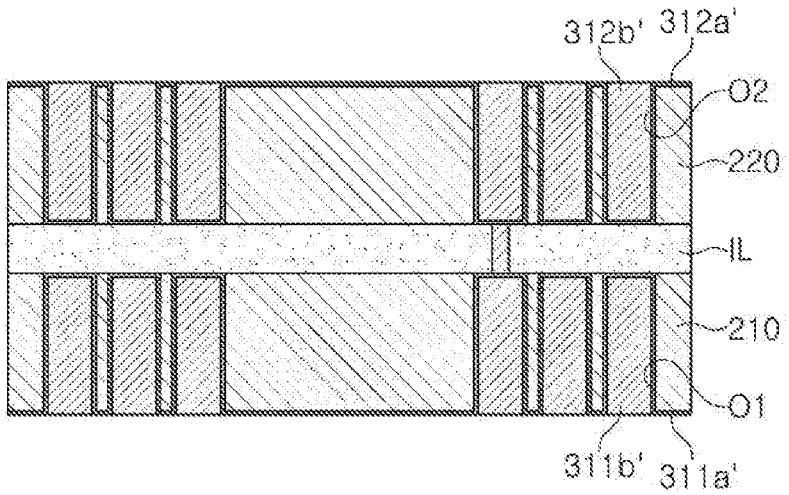

Referring to FIG. 6, electrical plating layers 311*b*' and 312*b*' may be formed on the seed portions 311*a*' and 312*a*' through an electroplating process.

In this case, electrical plating conditions such as composition of a plating solution, plating temperature, plating current and voltage, a plating time, and the like, may be adjusted to prevent the electrical plating layers 311*b*' and 312*b*' from extending to the other surfaces of the insulating walls 210 and 220.

When the electrical plating layers 311*b*' and 312*b*' extend to the other surfaces of the insulating walls 210 and 220, a general grinding process may be performed. In the exemplary embodiment, the electrical plating layers 311*b*' and 312*b*' may not extend to the other surfaces of the insulating walls 210 and 220, and thus, a general grinding process may be omitted.

Figure 7:
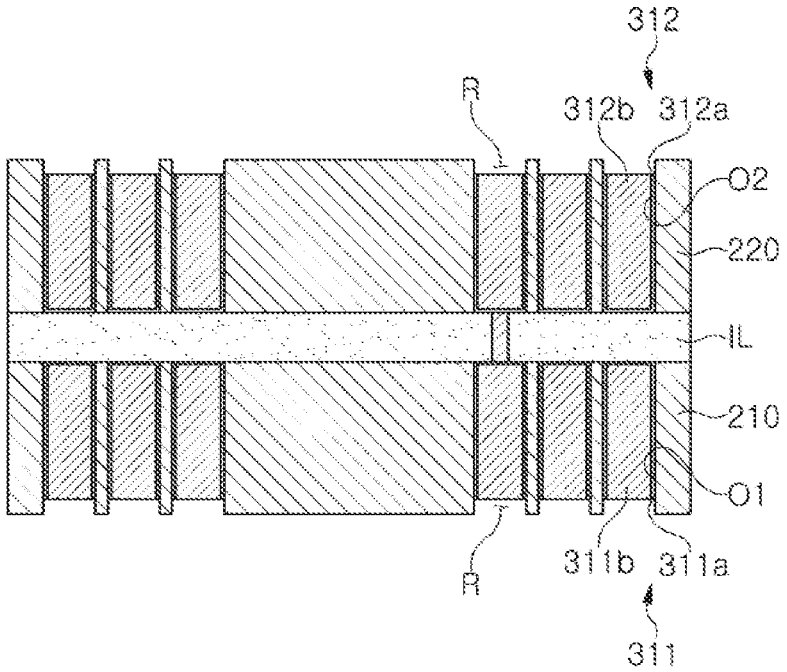

Referring to FIG. 7, at least portions of internal walls of the openings O1 and O2 may be exposed by partially removing the electrical plating layers 311*b*' and 312*b*' and the seed portions 311*a*' and 312*a*'.

This process may be undertaken through an etching process using an etchant which reacts to the seed portions 311*a*' and 312*a*' and the electrical plating layers 311*b*' and 312*b*' and does not react to the insulating walls 210 and 220. For example, when the seed portions 311*a*' and 312*a*' and the electrical plating layers 311*b*' and 312*b*' are an electroless copper plating layer including copper (Cu) and an electroplating layer, respectively, this process may be undertaken using a copper etchant.

By this process, portions of the seed portions 311*a*' and 312*a*' disposed on the other surfaces of the insulating walls 210 and 220, portions of the seed portions 311*a*' and 312*a*' disposed on the other surfaces of the coil patterns 311 and 312, and portions of the electrical plating layers 311*b*' and 312*b*' disposed on the other surfaces of the coil patterns 311 and 312 may be removed together. Thus, the recessed portion R may be formed on the other surfaces of the coil patterns 311 and 312.

Figure 8:
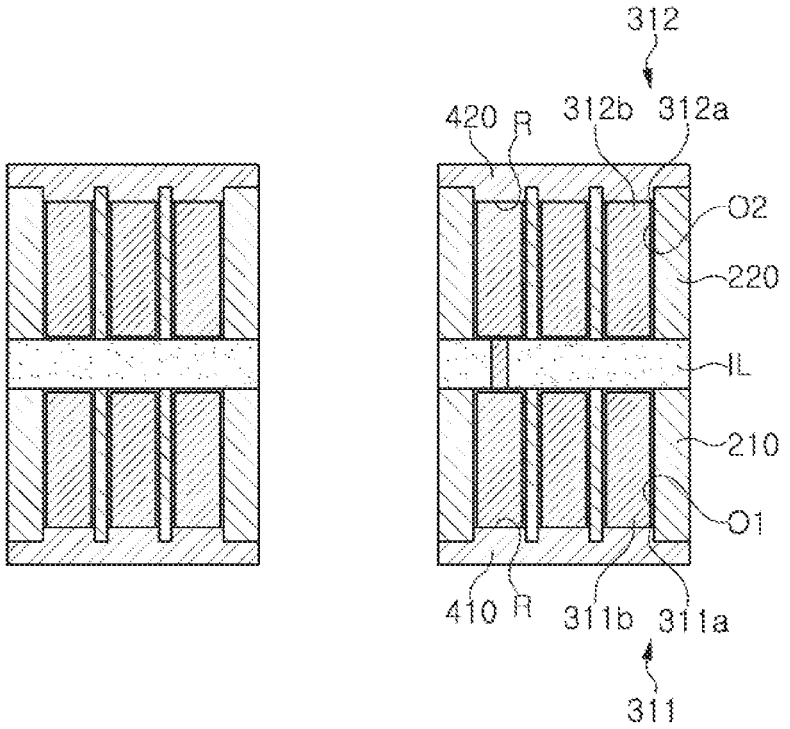

Referring to FIG. 8, cover insulating layers 410 and 420 may be formed on the insulating walls 210 and 220 and in the recessed portion R, and a through-hole penetrating through the coil patterns 311 and 312 and the internal insulating layer IL may be formed.

Although not illustrated, a magnetic composite sheet may be layered on both surfaces of the internal insulating layer IL, and the coil component may be manufactured accordingly.

According to the aforementioned exemplary embodiments, properties of a coil component may improve.

While the exemplary embodiments have been shown and described above, it will be apparent to those skilled in the art that modifications and variations could be made without departing from the scope of the present invention as defined by the appended claims.

What is claimed is:

1. A coil component, comprising:

a body;

an internal insulating layer buried in the body;

insulating walls disposed on the internal insulating layer, and including openings each having a planar coil shape having at least one turn;

coil patterns including first conductive layers disposed in the openings, and second conductive layers disposed between the first conductive layers and internal surfaces of the openings, and each having a first surface in contact with the internal insulating layer and a second surface opposing the first surface; and a recessed portion formed on the second surface of each of the coil patterns and exposing at least portions of the openings of the insulating walls, such that the coil patterns include a portion which becomes thicker from a central portion of the second surface towards the insulating walls.

2. The coil component of claim 1, wherein an aspect ratio between the coil patterns is within a range of 3:1 to 9:1.

3. The coil component of claim 1, wherein the recessed portion protrudes to the first conductive layers on a cross-sectional surface of the coil patterns.

4. The coil component of claim 1, wherein the insulating walls include a photosensitive insulating resin.

5. The coil component of claim 1, wherein the insulating walls include a photo acid generator and one or more types of epoxy resins.

6. The coil component of claim 1, wherein the coil patterns include first and second coil patterns respectively disposed on top and bottom surfaces of the internal insulating layer opposing each other, and the first and second coil patterns are connected to each other by a via penetrating through the internal insulating layer.

7. The coil component of claim 1, wherein the coil patterns have a planar coil pattern having at least one turn centered on a core of the body as an axis.

8. The coil component of claim 1, further comprising:

at least one external electrode electrically connected to one end of each of the coil patterns.

9. The coil component of claim 1, further comprising:

cover insulating layers covering the insulating walls and the recessed portion.

10. The coil component of claim 9, wherein the cover insulating layers each include at least one material selected from a group consisting of an epoxy resin, a polyimide resin, and a liquid crystalline polymer resin.

11. A coil component, comprising:

a body;

an internal insulating layer buried in the body;

insulating walls disposed on the internal insulating layer, and including openings each having a planar coil shape having at least one turn; and coil patterns including first conductive layers disposed in the openings, and second conductive layers disposed between the first conductive layers and internal surfaces of the openings, and each having a first surface in contact with the internal insulating layer and a second surface opposing the first surface, wherein a height of each of the insulating walls is greater than a height of each of the coil patterns in a stacking direction, such that the insulating walls protrude from the second surface of each of the coil patterns to define a recessed portion, and wherein the recessed portion is formed on the second surface of each of the coil patterns such that the coil patterns include a portion which becomes thicker from a central portion of the second surface towards the insulating walls.

12. The coil component of claim 11, further comprising:

cover insulating layers covering the insulating walls and the recessed portion.

13. The coil component of claim 11, wherein the coil patterns include first and second coil patterns respectively disposed on top and bottom surfaces of the internal insulating layer opposing each other, and the first and second coil patterns are connected to each other by a via penetrating through the internal insulating layer.

14. The coil component of claim 11, wherein the coil patterns have a planar coil pattern having at least one turn centered on a core of the body as an axis.

15. The coil component of claim 11, further comprising:

at least one external electrode electrically connected to one end of each of the coil patterns.

* * * * *